US006132320A

United States Patent [19]

Spoerl et al.

[11] Patent Number: 6,132,320

[45] Date of Patent: Oct. 17, 2000

[54] PLAYING SURFACE LEVELING APPARATUS AND METHOD

[76] Inventors: Brian J. Spoerl, 2000 N. 57th St., Milwaukee, Wis. 53208; Scott M. Spoerl, 2156 N. 63rd St., Wauwatosa, Wis. 53213

[21] Appl. No.: 09/158,234

[22] Filed: Sep. 22, 1998

[51] Int. Cl.[7] ..... A47C 17/62

[52] U.S. Cl. ..... 473/29; 248/188.4; 473/1

[58] Field of Search ..... 473/18, 29, 33, 473/FOR 18; 273/126 R; 248/188.2; 5/679; 52/126.5

[56] References Cited

U.S. PATENT DOCUMENTS

| | | | |
|---|---|---|---|
| 1,677,707 | 7/1928 | Compton | 473/29 |
| 2,627,407 | 2/1953 | Acland | 473/29 |
| 3,837,298 | 9/1974 | Leonhart | 473/1 |
| 4,027,878 | 6/1977 | Dadbeh | 473/29 |
| 5,161,797 | 11/1992 | Frasca | 473/29 |
| 5,623,792 | 4/1997 | Crumpacker | 52/126.7 |
| 5,839,966 | 11/1998 | Eisenhauer et al. | 473/29 |

*Primary Examiner*—Jeanette Chapman
*Assistant Examiner*—Mitra Aryanpour
*Attorney, Agent, or Firm*—Michael Best & Friedrich LLP

[57] ABSTRACT

An apparatus and method for leveling a playing surface, the apparatus preferably comprising an externally-threaded support rod, a collar threaded upon the support rod, a support surface or member upon which the playing surface rests, and a fastener securing the apparatus to an underlying surface. In one preferred embodiment, the support surface or member is part of the collar, and the threaded rod is fitted with a foot which rests upon the underlying surface. By turning the threaded rod with respect to the collar, the collar is moved up or down the support rod, thereby lifting or lowering the playing surface. In another preferred embodiment, the support surface or member is an annular element secured on the support rod against axial movement along the support rod, the collar being rigidly secured to the underlying surface. By turning the support rod with respect to the collar, the support rod is threaded out of or into the underlying surface, thereby lifting or lowering the playing surface. Access to the support rod is preferably made via an aperture in the playing surface into which the top of the support rod extends. The top of the support rod is preferably shaped to accept a tool inserted through the aperture in the playing surface for turning the support rod and adjusting the support level of the apparatus. Preferably, the apparatus is fastened to the underlying surface by a fastener passed through an axial aperture in the support rod and into the underlying surface.

24 Claims, 6 Drawing Sheets

PLAYING SURFACE LEVELING APPARATUS AND METHOD

FIELD OF THE INVENTION

The present invention relates to game playing surfaces, and more particularly, to an apparatus and method for leveling game playing surfaces.

BACKGROUND OF THE INVENTION

A number of games call for a playing surface upon which playing pieces are placed, rolled and/or moved in any number of manners. The rules of most such games require that the playing surface be level to some degree. For certain games (e.g., billiards and pool) in which playing pieces are particularly sensitive to how level the playing surface is, the requirement for a precisely leveled playing surface is very important to fair and proper game play. Achieving a high degree of precision for the level of a playing surface is a problem which is exacerbated by several variables. First, playing surfaces are often supported upon ground which itself is not level or which is unstable and which can change over time. Second, many playing surfaces are supported upon legs and/or a frame which by its construction or by its relationship to the playing surface may not support the playing surface in a highly level manner. For example, pool tables usually comprise a number of legs, a base frame secured and supported on top of the legs, slate (the playing surface) secured and supported on top of the base frame, and a number of rails secured and supported on top of the slate and/or the base frame to circumscribe the playing surface on the slate. The connection between the legs and the base frame and the base frame and the slate will inherently introduce some degree of imprecision into the level of the playing surface and increase the chances of an unsatisfactory playing surface. Similar results are found in other types of playing surfaces which are supported by multiple elements. Third, many playing surfaces themselves are not made from a single element. For example, pool tables often have a playing surface which is made from one, two, or three pieces of slate. Therefore, it is often necessary to level individual parts of the playing surface with respect to one another as well as with respect to the ground and the structure between the playing surface and the ground. Fourth, the playing surface and the structure supporting the playing surface will inevitably shift, sag, buckle, bow, or otherwise change over time. Such changes often result in undesirable modifications in the level of the playing surface. For example, the slate used for the playing surface of pool and billiards tables can slowly sag under its own weight (especially in lower-cost pool tables which employ thinner slate or thin slate backed and supported with wood). The causes of changes to a playing surface over time are typically a factor of material used, type and range of environmental conditions to which the playing surface and supporting structure are exposed, and the particular design, connection, and arrangement of the elements making up the playing surface and its supporting structure.

Many conventional systems and methods exist for leveling a playing surface in light of the variables just described. By way of example only, the following discussion regards the conventional systems and methods for leveling pool table surfaces. Such an example best facilitates insight into conventional playing surface leveling systems and methods because of the particularly exacting level standards required to play pool or billiards. However, it should be noted that other types of playing surfaces and the manner in which they are leveled are equally illustrative of the problems in conventional playing surface leveling technology. Therefore, it will be appreciated that the present invention is useful and finds application in solving leveling problems for all types of playing surfaces (including pool and billiards tables).

The conventional process of leveling a pool table is as follows. First, the legs and the base frame of the pool table are assembled and leveled upon the ground. The base frame can be leveled with respect to the legs by shims or by using a number of existing frame leveling devices well-known to those skilled in the art. After the leg and base frame assembly has been leveled, the pool table slate is placed upon the base frame. The slate can be one solid piece or can comprise two, three, or even more pieces which are typically placed in a side by side fashion on the base frame and are then secured in place to the base frame via conventional fasteners. The fasteners can be wood screws passed through apertures provided in the slate and into the base frame. The apertures in the slate are usually countersunk to permit the heads of the fasteners to rest therein without extending beyond the surface of the slate. Because the slates do not usually rest upon the base frame in a completely level fashion (due to inherent imperfections in the base frame, settling of the base frame under the weight of the slates, settling of the entire pool table and/or the supporting ground under the added weight of the slates, etc.), it is now necessary to level the slate pieces on top of the base frame. Typically, to accomplish this task, the fasteners are first loosened and shims are driven in appropriate places between the base frame and the underside of the slate pieces. These shims are usually made of pine, other types of wood, or other compressible or semi-compressible material. The shims compress slightly when the fasteners are once again tightened. Once the fasteners are tightened, the level of the slate pieces are checked and the level of each slate piece with respect to neighboring slate pieces is checked. If one or more pieces is not level, the process of fastener loosening, shim adjustment in appropriate places, and fastener tightening is repeated over and over again until the slate is completely level.

The conventional manner of playing surface leveling just described is unsatisfactory for a number of reasons. As can be expected from the description, the conventional process of leveling is very time consuming. Shims are particularly unsophisticated devices for making the frame adjustments required to perfectly level a playing surface. Not only are shims relatively difficult to adjust (by using a hammer and the right amount of hammering force upon the shims), but they are also subject to compression after their adjustment. Specifically, once the shims are hammered in place, the shims often compress as the fasteners tighten the slate to the base frame. This compression necessarily and undesirably changes the level of the slate. Therefore, the exact level resulting from proper shim adjustment and placement is typically a hit or miss proposition in which the user must crawl beneath the pool table, install, move, and/or shift shims, and then crawl from beneath the table to tighten the slate and check the resulting slate level. The repetition of this process is inefficient, cumbersome, and can be very frustrating, especially when one or more shims crack or break while the slate is being tightened (requiring the user to remove the broken shims and begin the leveling process over again).

Another problem with the conventional pool table leveling process described above is that shims used have a tendency to shift, crack, or even fall out of their locations over time. This occurs most commonly when the pool table is subjected to extreme or changing environmental conditions (e.g., a very dry room, repetitive swelling due to high or seasonal humidity, etc.). Unfortunately, these changes over time create the need for periodic re-leveling of the pool table.

Yet another problem with conventional pool table leveling systems and methods such as the one described above is a result of the location and arrangement of the fasteners and adjustment devices employed. Existing pool table leveling systems and methods rely upon fasteners to secure the slate pieces to the base frame and adjustment devices (shims) to adjust the level of the slate pieces in different locations around the slate pieces. The fact that the fastening locations are different than the adjustment locations causes undesirable stresses in the pool table slate pieces, especially during and after fastener tightening. Such stresses can cause the slate pieces to bow and even to crack. In cases where the pool table slate pieces are subject to a "memory" (i.e., where the slate pieces permanently deform when stressed or when stressed over prolonged periods of time), repeated adjustments to the pool table slates can result in permanently disfigured and ruined slates. Therefore, the practice of fastening a playing surface in a location which is different from the adjustment location of the playing surface is undesirable.

Therefore, a need exists for a playing surface leveling apparatus and method which permits a user to easily adjust the level of the playing surface at the same time as the playing surface level is monitored, allows for precise adjustment of the playing surface, does not employ elements susceptible to shifting or movement over time, uses an adjustment device which is readily accessible to a user (preferably from the top or sides of the playing surface) and easy to finely adjust, which does not subject the playing surface to undesirable stresses, and which preferably adjusts the playing surface in the same locations as it secures the playing surface to the underlying support structure. Each preferred embodiment of the present invention achieves one or more of these results.

SUMMARY OF THE INVENTION

The present invention is a playing surface leveling apparatus and method which preferably utilizes a jacking mechanism to adjustably support the level of the playing surface. The apparatus preferably includes an externally-threaded support rod which is secured between the playing surface and the underlying support frame or surface. To lift or lower the playing surface upon the support rod, the playing surface rests upon a support surface or member secured to the support rod. The support surface or member can be a collar which is threaded upon the support rod and which has an annular flange upon which the playing surface rests. Alternately, the support surface or member can be an annular disc or other body secured at a point along the length of the support rod and which also has an annular flange upon which the playing surface rests. The support rod can itself be supported upon the underlying frame or surface by either resting thereupon or by being threaded into the underlying frame or surface. In the first case, the support rod preferably is provided with a foot which distributes the load of the support rod to the underlying frame or surface. In the latter case, the support rod can be threaded into a collar rigidly fixed in the underlying frame or surface.

Depending upon the particular arrangement of elements, by rotating the threaded support rod with respect to the collar, the support rod either causes the collar to move up or down the length of the support rod (thereby lifting or lowering the playing surface), or threads itself out of or into the underlying surface or base frame (thereby also lifting or lowering the playing surface). Such adjustment requires access to either the support rod or the collar for turning either element. Access is facilitated in the preferred embodiment of the present invention by aligning the support rod with an aperture in the playing surface, into which the upper end of the support rod extends. The upper end of the support rod preferably has a tool connection member, such as a tool socket, tool flats, or tool grooves, by which a tool can be used to turn the support rod from above the playing surface. Alternately, access can be made to the collar by an access aperture in the side of the playing surface. The collar can be manufactured like a thumbwheel to be turned by hand or can be turned with a conventional tool inserted into the access aperture. In both such cases, and particularly with respect to adjustment of the apparatus via an aperture in the playing surface, the level of the playing surface is easily and accurately adjustable without requiring a user to have access to and/or crawl beneath the playing surface to adjust the level of the playing surface. By using threaded elements rather than shims for adjustment, more precision is possible in the playing surface leveling process and thereafter.

In the various embodiments of the present invention, to prevent the collar from turning with respect to the support rod, the collar is preferably secured to its adjacent element (e.g., the underlying frame or surface, or the underside of the playing surface, depending upon the particular embodiment described above). Preferably, the collar is provided with at least one spike driven into the adjacent element. Where such a manner of securing the collar is not preferred or possible, such as in the case where the collar supports a playing surface having no backing or other material into which the spike can be driven, multiple collars can be threaded upon the support rod to sandwich and secure the playing surface between the collars.

The support rod inserted into the aperture in the playing surface ensures that the playing surface will not shift with respect to the underlying frame or surface. To ensure that the apparatus itself does not shift (especially in the case where the apparatus simply rests upon the underlying frame or surface) and that the playing surface cannot be lifted from the underlying frame or surface, the apparatus further preferably comprises a fastener securing the apparatus in place. Preferably, the fastener is a screw which is passed through an axial aperture in the support rod and into the underlying frame or surface. The head of the fastener preferably rests upon an annular ledge within the axial aperture of the support rod.

It will be noted that apparatuses of highly preferred embodiments of the present invention act to both secure and adjust the playing surface in the same location. As such, the undesirable stresses from securing and adjusting the playing surface in different locations are avoided.

More information and a better understanding of the present invention can be achieved by reference to the following drawings and detailed description.

BRIEF DESCRIPTION OF THE DRAWINGS

The present invention is further described with reference to the accompanying drawings, which show preferred embodiments of the present invention. However, it should be noted that the invention as disclosed in the accompanying drawings is illustrated by way of example only. The various elements and combinations of elements described below and illustrated in the drawings can be arranged and organized differently to result in embodiments which are still within the spirit and scope of the present invention.

In the drawings, wherein like reference numerals indicate like parts.

DETAILED DESCRIPTION OF PREFERRED EMBODIMENTS

The following description of the present invention is presented in the context of a pool table. However, and as noted above, the present invention finds applicability to securing and adjustment of any playing surface.

Figure 1B:
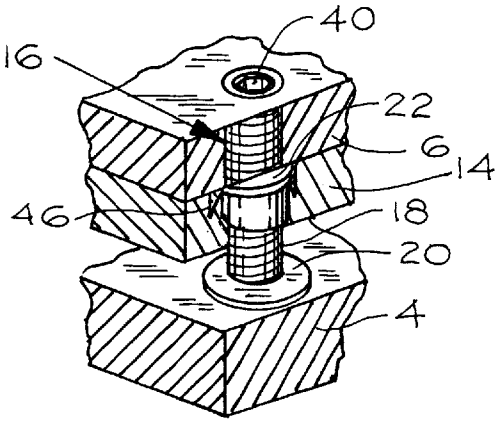
FIG. 1*b* is a magnified view of part of the view of FIG. 1, showing one of the devices of the present invention.
Figure 1A:
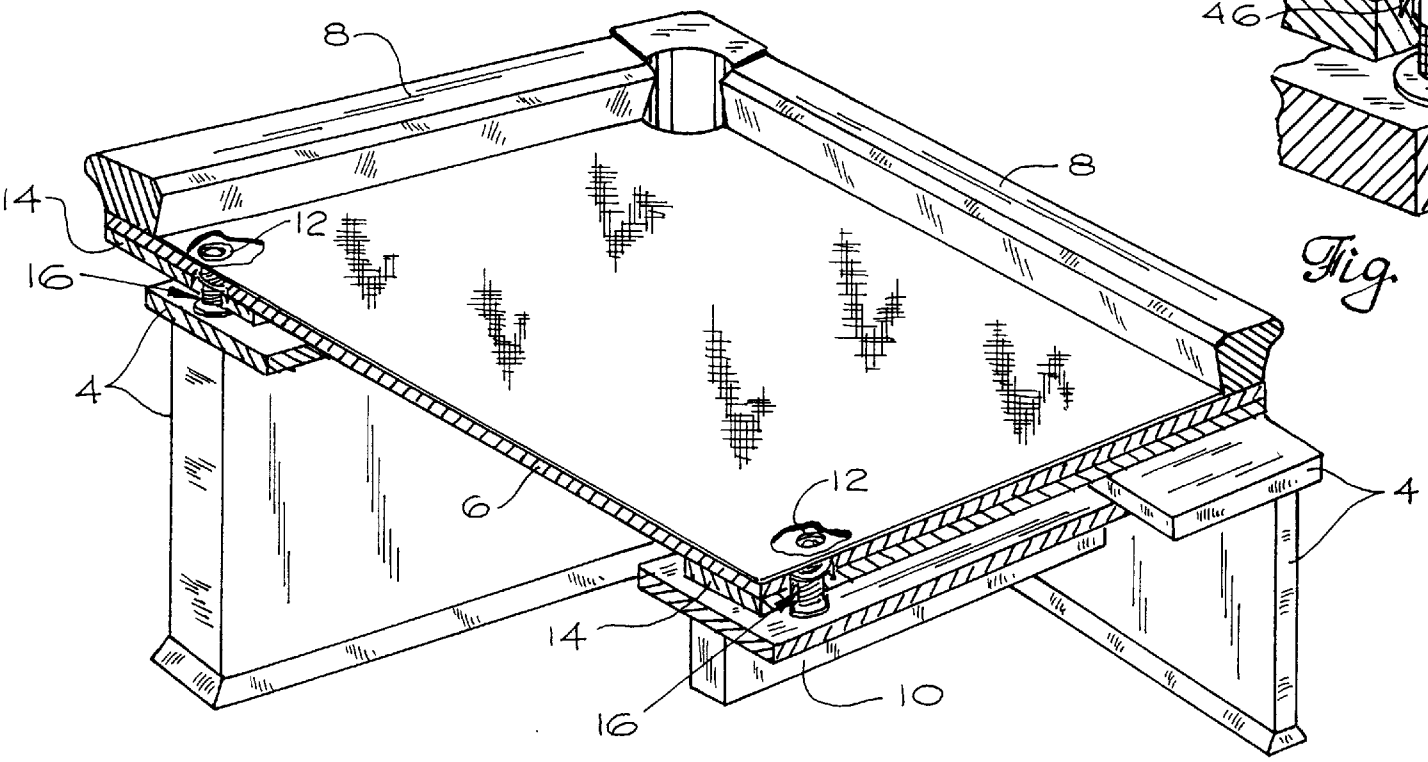
FIG. 1*a* is a perspective view of a pool table, partly sectioned to show the parts of the pool table and to show two leveling devices of the present invention installed thereon.

The operation and most highly preferred embodiments of the present invention can best be understood through a description of the general parts of a pool table, shown by way of example in FIG. 1. A pool table typically includes a set of legs (not shown), a base frame 4, a series of slate pieces 6 (only one of which is shown in the figures), and a number of rails 8. The legs can be attached to the base frame 4 and adjustable thereon in a number of manners well-known to those skilled in the art. The playing surface of the pool table is commonly made of a number of slate pieces 6 (e.g.: three) which are laid upon the base frame 4 in a side-by-side fashion. To ensure adequate support of the slate pieces 6 and to prevent sagging of the slate pieces on the base frame 4, a number of cross supports 10 are provided on the base frame 4. Many pool table slates are provided with pre-drilled apertures 12 which are countersunk and through which threaded fasteners (not shown) are passed to secure the slate 6 to the base frame 4 and cross supports 10. These same apertures 12 are preferably used in the installation of the present invention. However, where apertures 12 do not exist in the slate pieces 6, such apertures 12 can be drilled in appropriate places on the slate pieces 6 above the base frame 4 and/or the cross supports 10. Because drilling into slate is a process which must be performed carefully and with special tools to avoid damaging the slate, apertures are usually pre-drilled in places around the slate by the slate manufacturer. The device of the present invention can then be installed through the apertures 12 as more fully described below.

Although the slate pieces 6 need not necessarily have a backing, the slate pieces 6 illustrated in FIGS. 1, 1*a*, 4, 5, and 7 have a backing 14 for additional support and for securing playing surface treatments thereto (e.g., felt 15 wrapped around the edges of the slate pieces 6 and secured to the underside of the backing 14). The backing 14 is often made of wood, particle board, or compressed material and is typically secured to the underside of each slate piece 6 via glue, epoxy, or another adhesive substance. Both the backing 14 and the manner in which the slate pieces 6 are attached thereto are well-known to those skilled in the art and are therefore not discussed further herein.

The apparatus of the present invention (designated generally at 16) is preferably installed in a number of positions on each slate piece 6. Most preferably, the apparatus 16 is installed in a number of spaced-apart locations around the outer edges of each slate piece 6 above the base frame 4 and the cross supports 10. As will be described in more detail below, each apparatus 16 not only secures the slate pieces 6 to the base frame 4 and cross supports 10 at its particular location, but also acts as a vertical adjustment device for the slate piece 6 at the same location.

Figure 2:
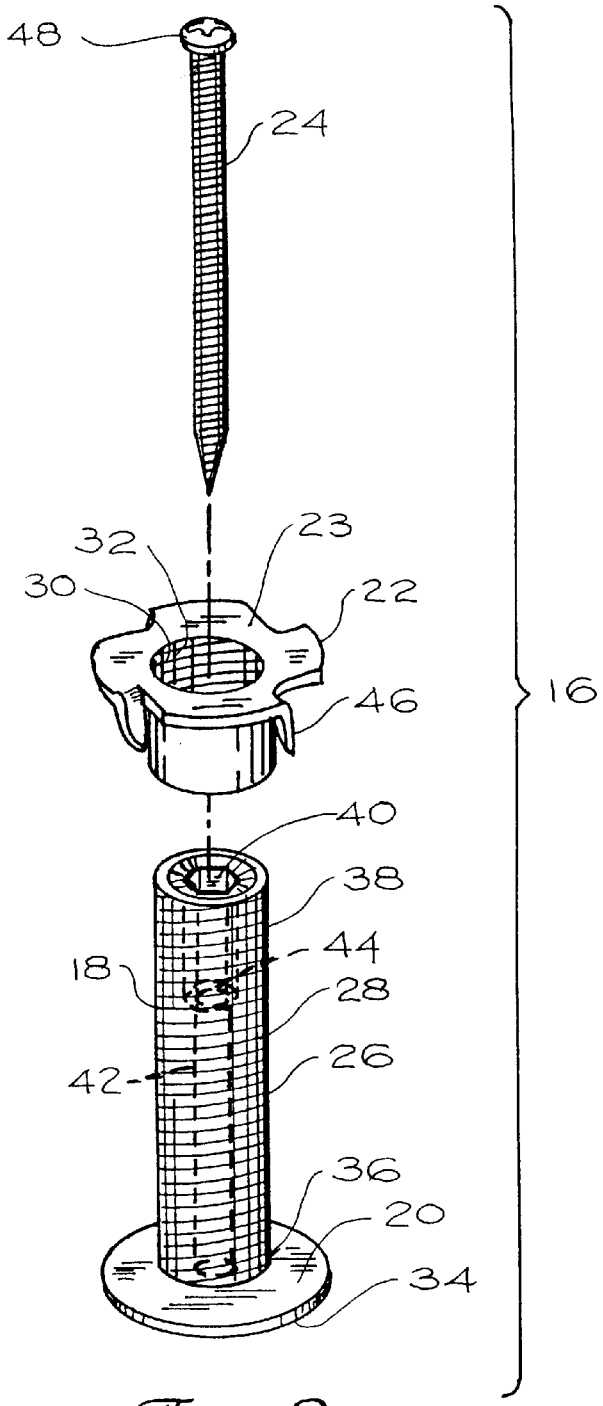
FIG. 2 is a exploded perspective view of a preferred embodiment of the apparatus according to the present invention.
Figure 3:
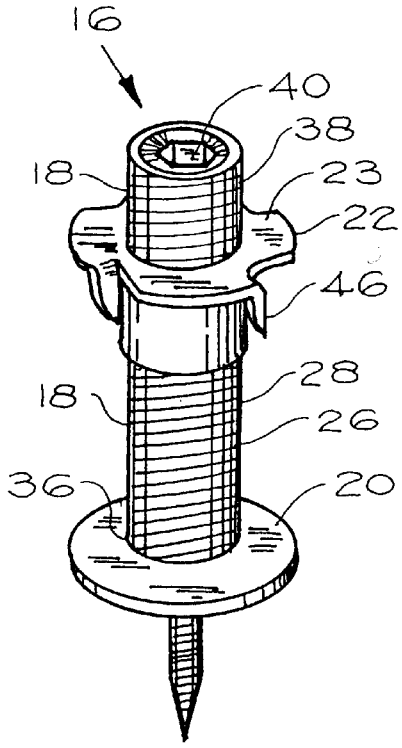
FIG. 3 is an assembled perspective view of the preferred embodiment of the apparatus shown in FIG. 2.

With particular reference to FIGS. 2 and 3, the preferred embodiment of the present invention comprises four parts: a support rod 18, a foot 20, a collar 22, and a fastener 24. Preferably, the outer surface 26 of the support rod 18 is sized and has threads 28 matching threads 30 on the inner surface 32 of the collar 22. The foot 20 is preferably a disc-shaped member having a central aperture 34 formed therethrough. The central aperture 34 of the foot 20 is sized to receive one end 36 of the support rod 18. Specifically, the end 36 of the support rod 18 preferably has no threads and extends into the central aperture 34 of the foot 20. The end 36 of the support rod 18 is flanged to prevent removal of the foot 20 from the support rod 18. The foot 20 is preferably secured to the support rod 18 so that it can rotate in position on the end 36 of the support rod 18. Preferably, on an opposite end 38 of the support rod 18 is a tool connection member 40 (which is preferably a tool socket, such as a socket for an allen wrench) axially aligned with the support rod 18. Also preferably, passing through the length of the support rod 18 is an axial aperture 42 (see FIG. 2) sized to receive the fastener 24. The axial aperture 42 is smaller than the tool socket 40, and therefore defines a shelf 44 (see FIG. 2) at the bottom of the tool socket 40 upon which the head of the fastener 24 rests as is more fully described below. The collar 22 preferably is T-shaped in cross-section and preferably has at least one spike 46 thereon which extends in a generally axial direction with respect to the axis of rotation of the collar 22. It should be noted that the collar 22 disclosed in the figures is only one collar type which can be used with the present invention. For example, collars having a longer or shorter threaded portion (indeed, approaching even the length of the threaded rod 18 or having an almost flat profile) are possible and fall within the scope of the present invention. The preferred T-shape of the collar 22 provides a support surface or member 23 upon which the playing surface can rest. This support surface or member 23 is preferably significantly wider than the diameter of the support rod 18 to distribute the weight of the slate piece 6 and backing 14 (if used).

Figure 4:
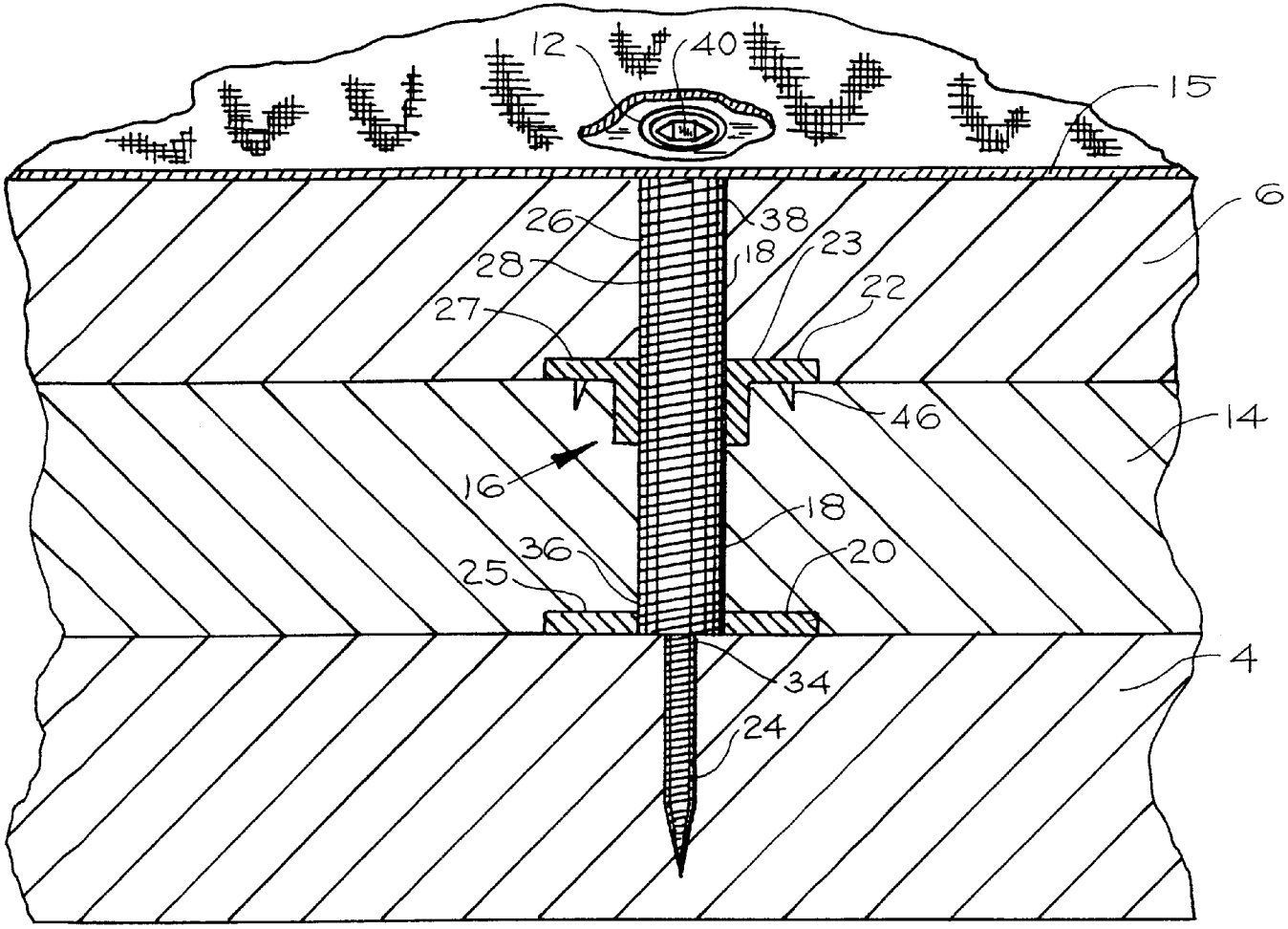
FIG. 4 is an elevational view of the preferred embodiment of the apparatus illustrated in FIGS. 2 and 3, partly sectioned and shown installed on a playing surface having a backing.
Figure 5:
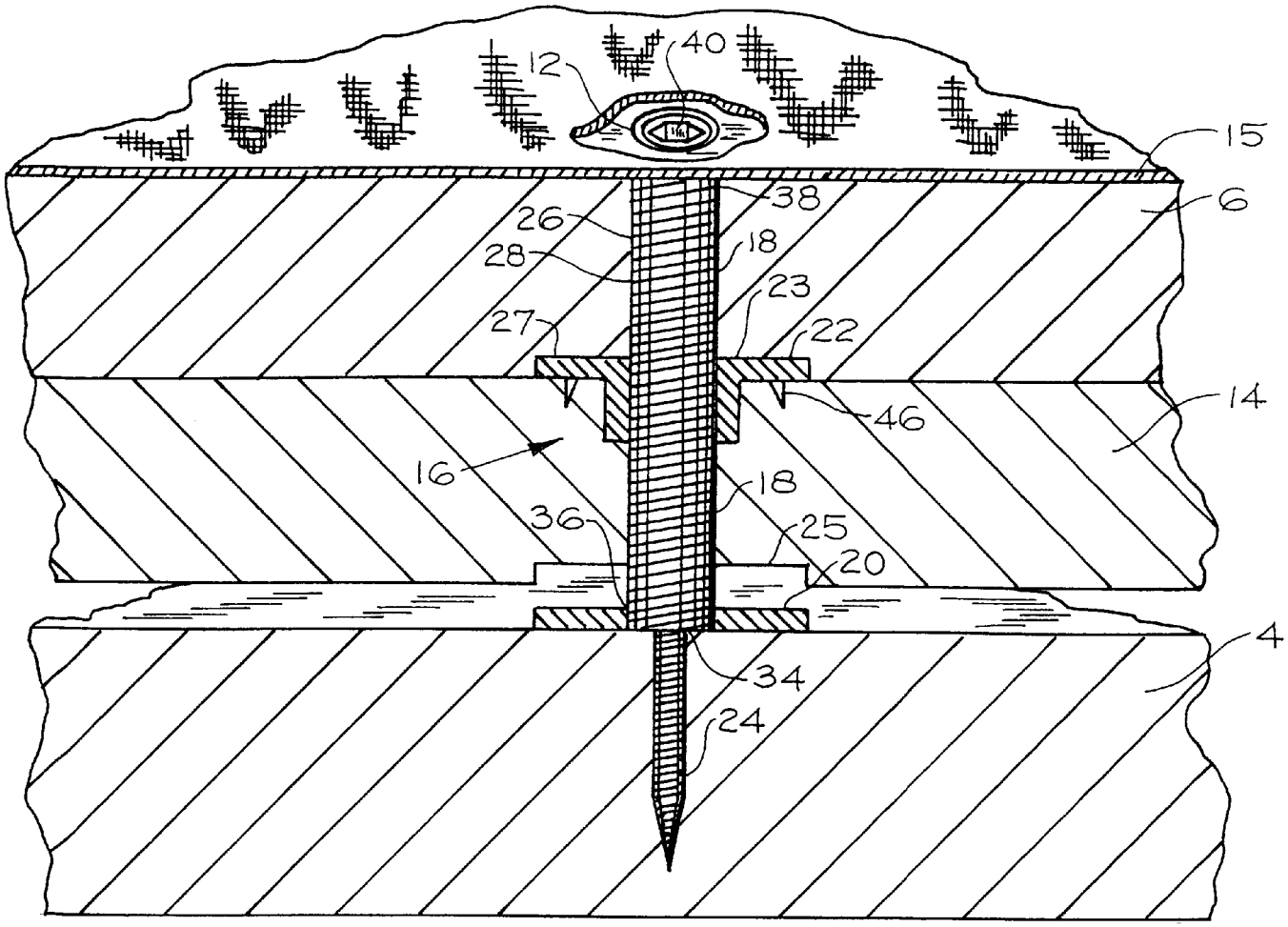
FIG. 5 is an elevational view, of the preferred embodiment of the apparatus illustrated in FIG. 4, partly sectioned and adjusted from the position in FIG. 4.

The installation and operation of the present invention can best be understood with reference to FIGS. 4 and 5. The apparatus of the present invention 16 acts essentially as a jack to raise and lower a particular location of a slate piece 6. This function is supplemented by the fact that the apparatus 16 preferably prevents the slate piece 6 from being pulled, shifted, or otherwise moved from position on the pool table. Therefore, a number of apparatuses 16 secured in various locations (described above) around each slate piece 6 act in concert to both support and secure the slate pieces 6 in a level position which is adjustable by a user. Installation of each apparatus 16 is preferably made through an aperture 12 in the slate piece 6 with which the upper end 38 of the support rod 18 is in substantial alignment (fitted within the aperture 12 and accessible by a tool through the aperture 12). To better establish alignment of the support rod 18 into the aperture 12 during apparatus installation, the connection between the foot 20 and the support rod 18 preferably permits slight play between the two elements. The foot 20 can even be pivotally secured to the support rod 18 in a convention manner, such as by a ball and joint connection, to permit an amount of pivoting motion of the support rod 18 with respect to the foot 20. When installed on a pool table having slates which are backed as described above (e.g., with wood glued to the underside of each slate piece 6), the apparatus 16 of the present invention is "jacked" up by pushing the slate piece 6 and attached backing 14 away from the underlying base frame 4 and cross supports 10. Specifically, the foot 20 of the apparatus 16 rests against the base frame 4 or cross support 10, while the slate piece 6 and the attached backing 14 are supported and lifted or lowered by the collar 22 threaded on the support rod 18. To avoid marring the base frame 4, the connection between the foot 20 and the support rod 18 is preferably recessed below the surface of the foot 20. It can be seen from FIGS. 4 and 5 that by turning the support rod 18 with respect to the collar 22 (or conversely, by turning the collar 22 with respect to the support rod 18 as described below), the collar 22 moves up or down the support rod, carrying the slate piece 6 and attached backing 14 with it. FIG. 4 shows the slate piece 6 and backing prior to adjustment, while FIG. 5 shows the slate piece 6 and backing 14 after the collar has been threaded in an upward direction along the support rod 18. Turning the collar 22 with respect to the support rod 18 in one direction exerts a lifting force upon the slate piece 6 and attached backing 14, while turning the collar 22 with respect to the support rod 18 in an opposite direction permits the slate piece 6 and attached backing 14 to lower under the force of gravity. To accomplish these adjustments, the preferred embodiment of the present invention illustrated in the figures can be manipulated by a tool attachable to the apparatus 16 while the apparatus 16 is in its installed position shown in FIGS. 4 and 5. Specifically, the end 38 of the support rod 18 opposite the foot 20 preferably extends through an aperture 12 in the slate piece 6. As described above, the end 38 of the support rod 18 preferably has a socket 40 for receiving an allen wrench. To ensure a smooth playing surface, the end 38 of the support rod 18 does not extend beyond the surface of the slate piece 6, and preferably is slightly recessed within the aperture 12 in the slate piece 6. The apparatus 16 is adjustable by inserting the allen wrench (not shown) into the socket of the support rod 18, and by turning the support rod 18 with the allen wrench. By virtue of its rotatable connection on the lower end 36 of the support rod 18, the foot 20 preferably does not rotate with the support rod 18 as the support rod 18 is turned, thereby lowering the torque required to turn the support rod 18. It will be appreciated by one having ordinary skill in the art that other tools can be used to turn the support rod 18. For example, the tool socket 40 can be a conventional ratchet socket to fit a ratchet wrench. Alternately, the tool socket 40 can be replaced by one or more slots across the top of the support rod 18 for a screwdriver to fit within. The top of the support rod 18 can even be formed in the shape of a tool connection member around which a tool can be fitted, such as a wrench head (a crescent or box wrench head), in which case two or more flats can be made at the top of the support rod 18.

As noted above, problems exist from the prior art practice of securing the slate pieces 6 in locations which are different from slate adjustment locations (e.g., locations where shims are placed and adjusted). To avoid these problems, the present invention also acts to secure the slate piece 6 in place upon the base frame 4. The slate piece 6 is kept from sliding on the base frame 4 by having one or more support rods 18 extending through apertures 12 in the slate pieces 6. To keep the slate pieces 6 from being lifted off of the base frame 4, a fastener 24 is preferably employed. The fastener 24 is preferably a wood screw which is passed through the axial aperture 42 in the support rod 18 and is screwed into the base frame 4 or a cross support 10. The head 48 of the fastener 24 rests against the shelf 44 at the bottom of the tool socket 40, and keeps the assembly 16 in place against the base frame 4 or the cross support 10. To keep the slate piece 6 and attached backing 14 attached to the assembly 16, the collar 22 is preferably nested between the slate and the backing (see FIGS. 4 and 5), and can be placed therein prior to attachment of the slate piece 6 to the backing 14. To better ensure that the collar 22 does not rotate with the support rod 18 when the support rod 18 is turned, the spikes 46 of the collar 22 preferably are driven into the backing 14. It should be noted, however, that the collar 22 can be secured against rotation in a number of manners well-known to those skilled in the art, such alternate securing methods depending largely upon the material making up the backing 14 and the playing surface. Examples of alternative securing methods include welding, riveting, press-fitting, etc. In each of the embodiments described herein, elements such as the collar 22 which are threaded upon the support rod 18 can have their threads coated with a locking substance such as thread locking paste, putty, etc. or can be fitted with a thread locking insert (not shown) such as a nylon locking insert, etc., when it is desired to prevent or limit threaded movement of the element with respect to the support rod 18.

Although the fastener 24 is preferably a wood screw, other fastener types can be used with the apparatus 16 of the present invention. For example, the fastener 16 can be a machine screw, a rivet, a nail, or other conventional fastener.

Due to its location on the pool table and the accessibility of the apparatus 16 from the top of the pool table, the apparatus 16 of the present invention described above can be quickly adjusted without requiring the user to repeatedly crawl to and from beneath the pool table to adjust the slate pieces 6. The nature of the threaded support rod 18 and the threaded collar 22 also permits very precise adjustment of the height of the slate pieces 6 at the locations of the apparatuses 16. Additionally, because the apparatuses 16 also act to secure the slate pieces 6 in place, undesirable stresses caused by different securing and adjustment locations are avoided.

It should be noted that in preferred installation, the slate pieces 6 making up the playing surface preferably rest upon the base frame 4 as much as possible. In a perfect arrangement, the slate pieces 6 rest and are fully supported upon the base frame 4 without being supported by any part of the apparatus 16. However, it is virtually always necessary to level some part of each slate piece 6. Therefore, each slate piece 6 must be supported to some extent by one or more (as few as possible) of the apparatuses 16. To the extent that the slate pieces 6 rest and are supported solely upon the base frame 4, it is desirable to prevent interference by the apparatus 16 between the slate pieces 6 and the base frame 4. The feet 20 and collars 22 are therefore preferably recessed into recesses 25, 27 within the base frame 4 and the backing 14 or slate pieces 6, respectively (in the figures, the foot 20 is shown recessed within recesses 25 in the backing 14, while the collar 22 is shown recessed within recesses 27 in the underside of the slate piece 6. Other embodiments of the present invention described below also preferably employ recesses for elements located between the slate pieces 6, backings 14, and the base frame 4.

Each element in the apparatus 16 (the foot 20, the support rod 18, the fastener 24, and the collar 22) are preferably made of a high-strength material such as steel, aluminum, or iron. Depending largely upon the particular playing surface used, aesthetics, strength requirements, and material cost, any of these elements can be made of a number of other materials, such as other metals, plastic, high-strength nylon, composites, wood, stone, ceramics, glass or combinations thereof. However, because high-strength metals are not readily susceptible to deformation, cracking, or fatigue, such materials are preferred for the apparatus 16 elements of the present invention (and present a distinct advantage over conventional wood shims which can break, compress, or fall out over time).

Figure 6:
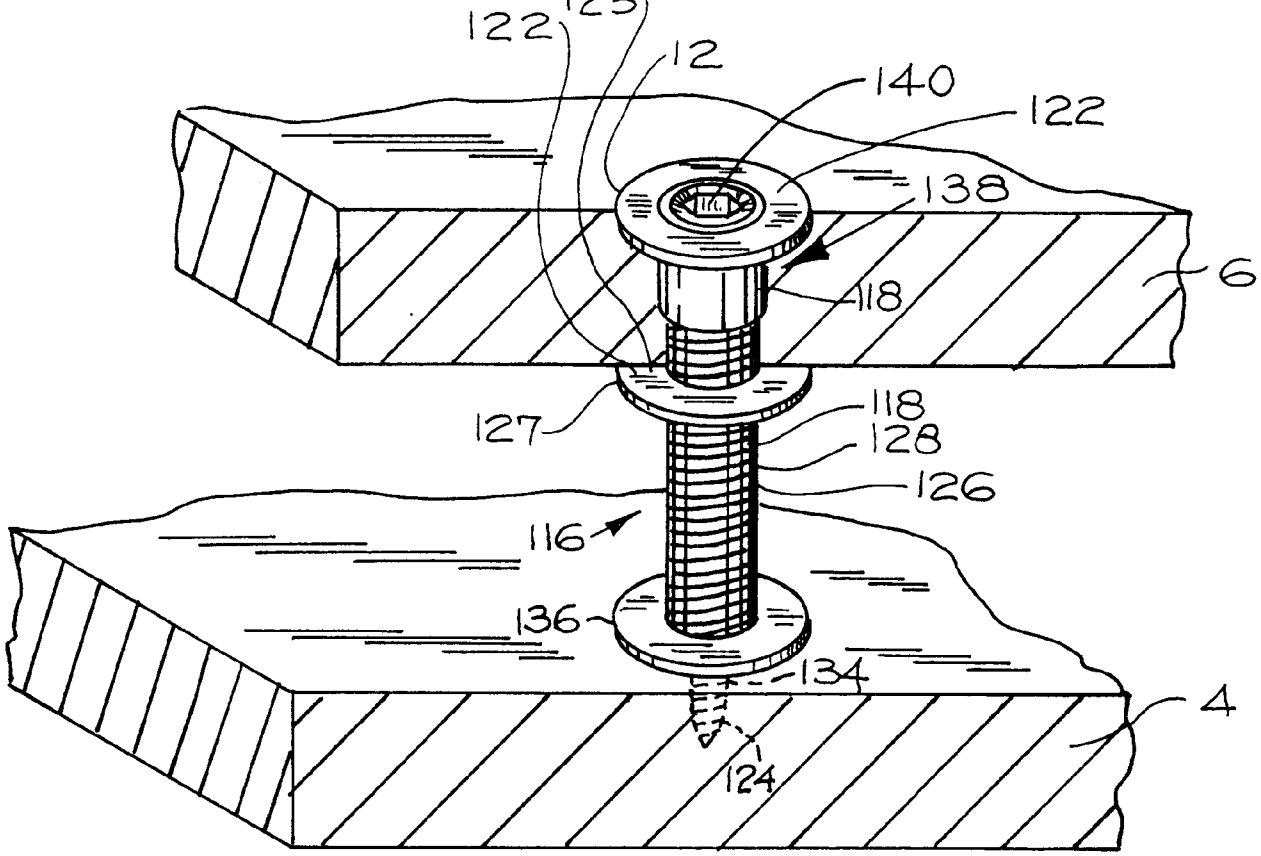
FIG. 6 is an perspective elevational view of a second preferred embodiment of the apparatus according to the present invention, shown installed on a playing surface having no backing.

A second embodiment of the present invention is illustrated in FIG. 6. The apparatus 116 as shown in FIG. 6 is similar to the first embodiment 16 of the present invention described above and illustrated in FIGS. 2–5, except that it is adapted for use with pool tables which have no backing 14. As such, elements comparable to those identified in the first preferred embodiment of the present invention are shown in FIG. 6 in the one-hundred series of reference numbers (e.g., support surface or member 123, fastener 124, support rod outer surface 126, recesses 127, threads 128, foot aperture 134, support rod ends 136, 138, and tool socket 140). In such a case the first preferred embodiment can still be used to adjust the slate pieces 6 and to keep the slate pieces from sliding on the base frame 4, but the slate pieces 6 are not secured against being lifted off of the base frame 4 (the collar 22 is not sandwiched between the backing 14 and the slate piece 6). In such a case, it is preferred to use two collars 122 upon the support rod 118. One collar 122 is located above and one collar 122 is located below the slate piece 6. As an alternative to the spikes 46 on the collar 22 of the first preferred embodiment (such spikes not being suitable for driving into the slate pieces 6 to prevent rotation of the collars 122 with the support rod 118), the collars 122 can be secured to the slate pieces 6 in a number of ways, such as with glue, epoxy, etc., or can be lined with a low-slip high-friction material which grips the slate piece 6 as the collar 122 is tightened thereon. In either case, the collars 122 are preferably secured against rotation with the support rod 118 as the support rod 118 is turned. Depending upon the material used for other types of playing surfaces, the collars 122 can be secured in a number of manners to the underside of the playing surface, such as by welding, by using spikes similar to the first preferred embodiment, etc. The top collar 122 is preferably recessed within a countersink in the slate piece 6 to ensure a smooth playing surface. The remaining elements and the function of the second preferred embodiment just described is preferably the same as the first preferred embodiment described above.

Figure 7:
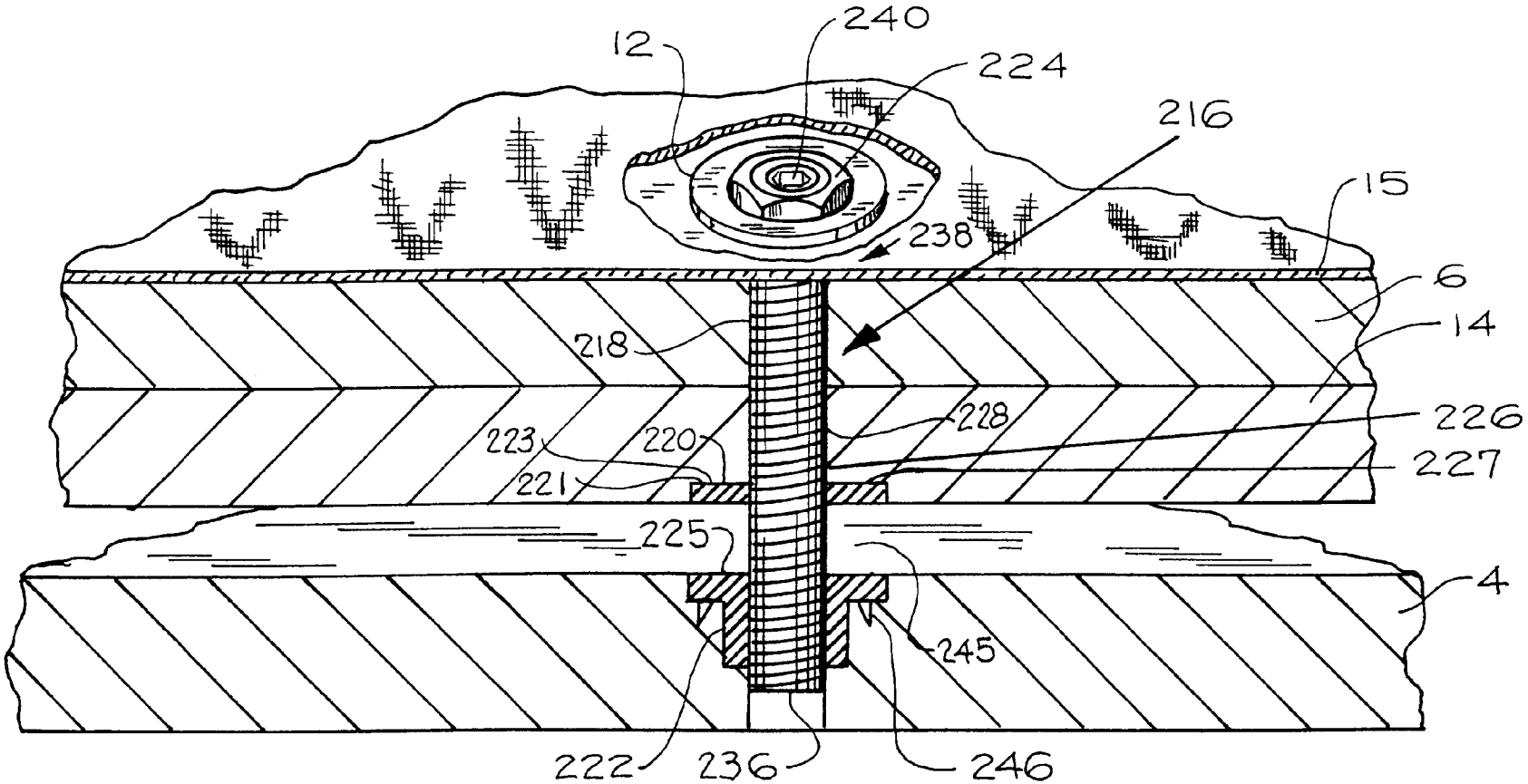
FIG. 7 is an perspective elevational view of a third preferred embodiment of the apparatus according to the present invention.

A third embodiment of the present invention is illustrated in FIG. 7. Elements comparable to those identified in the first preferred embodiment of the present invention are shown in FIG. 7 in the two-hundred series of reference numbers (e.g., apparatus 216, support surface or member 223, support rod outer surface 226, threads 228, and support rod ends 236, 238). The third preferred embodiment operates in a very similar manner to the first and second embodiments described above and illustrated in FIGS. 2–6. However, the support rod 218 used with the third preferred embodiment preferably does not have an axial aperture therethrough. Like the first and second embodiments of the present invention, the third embodiment has a collar 222. However, rather than being sandwiched between the slate piece 6 and the backing 14 (see the first preferred embodiment) or being secured beneath the slate (see the second preferred embodiment), the collar 222 is secured in place in the base frame 4 or the cross supports 10 and is preferably recessed within recess 225 in the base frame 4. Specifically, the collar 222 is preferably provided with spikes 246 which are driven into the base frame 4 or the cross supports 10. It should be noted, however, that different manners of securing the collar 222 to the base frame 4 or cross supports 10 are possible. For example, one or more fasteners (not shown) can be passed through axially-aligned apertures in the collar flange 245 and driven into the base frame 4 or cross supports 10. Alternatively (and dependent upon the type of material comprising the base frame 4 and cross supports 10), the collar 222 can be welded, glued, press fit, or secured to the base frame 4 or cross supports 10 in any number of manners well known to those skilled in the art.

The support rod 218 preferably has a support flange 220 secured in a middle portion thereof. The support flange 220 is preferably disc shaped and can rotate with respect to the support rod 218. However, the support flange 220 is secured against axial movement along the support rod 218. Though the support flange 220 is preferably rotatably secured in a middle portion of the support rod 218, the support flange 220 can instead by fully secured in place (such as by welding, gluing, etc.), or can even be made integral with the support rod 218. Also, although the support flange 220 is preferably a disc-shaped body, a number of other body shapes are possible which similarly act to support the slate piece 6 or backing 14 across a surface of the body.

In operation, the support rod 218 is preferably passed through a countersunk aperture in the slate piece 6 and is threaded into the collar 222 secured to the base frame 4 or cross support 10. The slate piece 6 and backing 14 rests upon the support flange 220, which is recessed into recess 227 for reasons described above with reference to the first and second preferred embodiments. Specifically, the support flange 220 preferably has a support surface or member 221 upon which the slate piece 6 rests. In the event that the slate piece 6 is supported with a backing 14, the slate backing 14 instead rests upon the support surface or member 221. When fully installed as shown in FIG. 7, the support rod 218 preferably extends through the threads of the collar 222 and up into the aperture 12 in the slate piece 6. By turning the support rod 218 via the tool socket 240, the support rod 218 is threaded up or down within the collar 222 in the base frame 4 or cross support 10. This motion of the support rod 218 raises or lowers the support flange 220, which in turn raises or lowers the slate piece 6. It should be noted that it is possible to dispense with the collar 222 where the base frame 4 or cross support 10 is itself provided with an internally threaded aperture matching the threads of the support rod 218. This alternative will largely depend upon the material and material strength of the base frame 4 or cross support 10 and the weight of the slate piece 6 and backing 14. To ensure that the slate piece 6 and attached backing 14 (if used) are secured from being lifted off of the base frame 4 and the cross supports 10, a nut 224 is preferably threaded on the upper end 238 of the support rod 218 and seats within the countersunk aperture 12 of the slate member 6. The nut 224 is preferably a locking nut, but can be any body which is threaded to seat within the countersunk aperture 12 in the slate member 6 and which holds the slate member 6 down upon the base frame 4 or the cross supports 10.

The embodiments described above and illustrated in the figures are presented by way of example only and are not intended as a limitation upon the concepts and principles of the present invention. As such, it will be appreciated by one having ordinary skill in the art that various changes in the elements and their configuration and arrangement are possible without departing from the spirit and scope of the present invention as set forth in the appended claims.

For example, it is evident from the description of the three embodiments described above that adjustment of the device of the present invention is performed by rotation of the support rod 18, 118, 218. By rotating the support rod 18, 118, 218 in each embodiment, an element fixed in some way with respect to the support rod 18, 118, 218 (e.g., a collar 22, 122 rotatable with respect to the support rod 18, 118, or a support flange 220 secured along the length of the support rod 218) lifts or lowers the slate piece 6 and backing 14 with respect to the base frame 4 or cross support 10. In each embodiment disclosed, the support rod 18, 118, 218 is turned via a tool socket 40, 140, 240. However, one having ordinary skill in the art will appreciate that the support rod 18, 118, 218 can be turned in any number of ways by a user. For example, a thumbwheel (now shown) can be secured to the support rod 18, 118, 218 and which can be made accessible to a user by being fitted through a slot or adjustment aperture in the side of the pool table (e.g., through the side of the rail 8 or through the side of the base frame 4). Of course, in the case of the third embodiment, it is possible that the support flange 220 itself be made of a sufficient diameter to be accessible from the side of the rail 8 or base frame 4 through such a slot or aperture. By turning the support flange 220, the support rod 218 can be raised or lowered within the collar 222 on the base frame 4, thereby lifting or raising the slate piece 6 or backing 14 at that point. In alternate embodiments of the present invention where the collar 22, 122, 222, upon which the slate piece 6 or backing 14 rests is not secured or attached to the slate piece 6, backing 14, base frame 4, or cross support 10 (i.e., where the collar 22, 122, 222 acts only to support the slate piece 6 and backing 14), it is even possible to use the collar 22, 122, 222 as a thumbwheel and to secure the support rod 18, 118, 218 against rotation. A distinct advantage of the "thumbwheel" embodiments is that access to the apparatus of the present invention need not be from the top of the playing surface. Instead, and rather than remove playing surface treatments such as felt wax, etc. from the playing surface to obtain adjustment access to the apparatus, adjustment access is virtually instantaneous.

It will also be appreciated by one having ordinary skill in the art that obvious variations in the lifting mechanism employed in the present invention are possible. Essentially, the elements necessary to adjustably support a particular location on a playing surface can vary widely, and to the same degree as jacking mechanisms. For example, rather than use a vertical threaded rod jack arrangement as disclosed above, a scissors-lift jack can be employed with the same effect. Specifically, a plurality of scissors-lift mechanisms of small conventional design (e.g., a long horizontal threaded rod having two support members threaded on either end and attached together above and below the threaded rod in a diamond-shaped fashion) can replace the support rod 18, 118, 218 and collar 22, 122, 222 arrangement disclosed above. Because conventional scissors lift designs typically require a crank rod extending horizontally from the scissors lift, side access apertures in the rails 8 or in the base frame 4 preferably are used in such an embodiment for passing the crank rods to access locations beside the playing surface. Adjustment of the playing surface is then performed by cranking the individual crank rods in the sides and ends of the playing surface, thereby raising or lowering the individual apparatuses in much the same way as the devices disclosed above. Other styles of conventional jacking mechanisms can also be used in connection with the present invention. For example, the vertical threaded rod jack arrangement disclosed in the preferred embodiments above can be replaced by vertical ratchet jacks commonly used in the automobile jack industry. Once again, adjustment access to each such apparatus installed in the locations beneath the slate pieces 6 and backings 14 can be made from the side of the playing surface, if desired (see the scissors lift apparatus mentioned above). As with the scissors lift alternative, such variations of the present invention are not preferred due to their inherently more complex nature and/or the need for certain designs to have side access to the individual apparatuses for adjustment.

Finally, it will be appreciated by one having ordinary skill in the art that though access to the installed apparatuses of the present invention from the top or side of the playing surface is preferred, alternate embodiments of the present invention can be used to provide adjustment access to the apparatuses from beneath the playing surface. For example, in the third preferred embodiment of the present invention described above, the tool socket 240 on the upper end 238 of the support rod 218 can instead be located on the lower end of the support rod 218. The apparatus 216 is preferably still attached to the slate piece 6 and backing 14 (if used) by having a bolt head or nut located in the position of the nut 224 shown in FIG. 7 to clamp the slate piece 6 and backing 14 to the apparatus 16. Such an arrangement has the advantage of permitting adjustment of the slate piece 6 without disturbing surface treatments on the playing surface. Also, where the top end 238 of the support rod 218 does not pass through the aperture 12 in the slate piece 6 and backing 14, but instead is secured (e.g., by gluing, epoxy, etc.) directly to the underside of the slate piece 6 or backing 14, such an embodiment avoids the need for apertures 12 in the slate or for aperture alignment. Therefore, though not preferred, the present invention installed so as to be adjustable from beneath the playing surface can provide its own distinct advantages.

Having thus described the invention, what is claimed is:

1. A combination apparatus for leveling a slate of a pool or billiard playing table upon a base frame, the combination apparatus comprising:

the slate and the base frame;

a rod having external threads, an upper end and a lower end; and a collar having internal threads, the collar threaded upon the rod and having a support surface located a length from the upper end and upon which the slate rests a distance above the base frame, the distance being adjustable by rotating the collar with respect to the rod to move the rod axially with respect to the collar.

2. The apparatus as claimed in claim 1, wherein the slate of the pool-type playing table has an aperture formed therethrough, the apparatus further comprising:

a tool connection member on the upper end of the threaded rod, the tool connection member adapted for connection with a tool passed through the aperture and connected to the tool connection member, the threaded rod rotatable by manipulation of a tool connected to the tool connection member.

3. The apparatus as claimed in claim 2, wherein the tool connection member is an allen wrench socket.

4. The apparatus as claimed in claim 1, wherein the collar is adapted for attachment to the slate of the pool or billiard playing table, the threaded rod maintaining axial position with respect to the base frame as the threaded rod is turned.

5. The apparatus as claimed in claim 4, wherein the collar has at least one spike thereon for engagement with backing on the slate.

6. The apparatus as claimed in claim 1, wherein the collar is adapted for attachment to the base frame, the distance of the slate above the base frame being adjustable by screwing the threaded rod into and out of the base frame.

7. The apparatus as claimed in claim 6, wherein the collar has at least one spike thereon for engagement with the base frame.

8. The apparatus as claimed in claim 5, wherein the playing surface includes a planar member and a backing.

9. The apparatus as claimed in claim 1, further comprising a foot member attached to the lower end of the threaded rod, the foot member resting upon the base frame.

10. The apparatus as claimed in claim 9, wherein the foot member is rotatably secured in position on the lower end of the base frame permitting rotation of the threaded rod without rotation of the foot member.

11. The apparatus as claimed in claim 1, wherein the threaded rod has an axial passage formed therethrough, the apparatus further comprising a fastener received within the axial passage and attached to the base frame, the fastener securing the apparatus to the base frame.

12. The apparatus as claimed in claim 1, wherein the collar defines a first collar, the apparatus further comprising a second collar having internal threads, the second collar threaded upon the threaded rod to hold the slate of the pool or billiard playing table between the first collar and the second collar.

13. A combination apparatus for leveling a slate of a pool or billiard playing table upon a base frame, the slate having an aperture formed therethrough, the combination apparatus comprising:

the slate and the base frame;

a thread rod having a top end in substantial alignment with the aperture and having a body extending beneath the slate; and;

a collar threaded upon the threaded rod, the collar having a support surface underlying and supporting the slate;

the support surface exerting a lifting force upon the slate when the threaded rod is rotated with respect to the collar in a first direction and permitting the slate to lower when the threaded rod is rotated with respect to the collar in a second direction.

14. The apparatus as claimed in claim 13, wherein the top end of the threaded rod is shaped to connect to a tool inserted into the aperture for turning the threaded rod.

15. The apparatus as claimed in claim 13, wherein the collar is attached to the slate of the pool or billiard playing table and is secured against rotation with the threaded rod.

16. The apparatus as claimed in claim 15, wherein the threaded rod has a bottom end opposite the top end, the apparatus further comprising a foot secured to the bottom end and adapted to rest upon the base frame.

17. The apparatus as claimed in claim 13, wherein the collar is attached to the base frame and is secured against rotation with the threaded rod threaded into and out of the base frame.

18. The apparatus as claimed in claim 13, further comprising a foot attached to a lower end of the threaded rod and adapted to rest upon the base frame underlying the slate of the pool or billiard playing table.

19. The apparatus as claimed in claim 13, used in connection with a slate having a support member underlying the slate, wherein the apparatus is adapted to be secured to the support member.

20. The apparatus as claimed in claim 13, further comprising a fastener passing through an aperture formed in the threaded rod, the fastener securing the apparatus to the base frame.

21. The apparatus as claimed in claim 13, wherein the collar is a first collar, the apparatus further comprising a second collar also threaded upon the threaded rod, the first collar underlying and supporting the slate and the second collar located above the slate when the apparatus is installed on the slate.

22. A method for leveling a slate of a pool or billiard playing table upon a base frame, comprising the steps of:

providing a threaded rod extending from the slate of the pool or billiard playing table;

providing a collar threaded upon the threaded rod, the collar having a support surface disposed a distance above the base frame;

supporting the late upon the support surface of the collar; and rotating the threaded rod with respect to the collar to alter the distance between the support surface and the base frame.

23. The method as claimed in claim 22, further comprising the step of fastening the threaded rod to the base frame to prevent axial movement of the threaded rod with respect to the base frame.

24. The method as claimed in claim 22, further comprising the steps of:

providing a foot on a lower end of the threaded rod;

resting the foot upon the base frame to support the threaded rod upon the base frame.

* * * * *